US007925029B2

(12) United States Patent
Hollemans et al.

(10) Patent No.: US 7,925,029 B2
(45) Date of Patent: Apr. 12, 2011

(54) PERSONAL AUDIO SYSTEM WITH EARPIECE REMOTE CONTROLLER

(75) Inventors: Gerrit Hollemans, Eindhoven (NL); Vincentius Paulus Buil, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1119 days.

(21) Appl. No.: 10/552,769

(22) PCT Filed: Apr. 15, 2004

(86) PCT No.: PCT/IB2004/050454

§ 371 (c)(1), (2), (4) Date: Oct. 12, 2005

(87) PCT Pub. No.: WO2004/093490

PCT Pub. Date: Oct. 28, 2004

(65) Prior Publication Data

US 2006/0215847 A1 Sep. 28, 2006

(30) Foreign Application Priority Data

Apr. 18, 2003 (EP) ..... 03101081

(51) Int. Cl.
*H04R 1/10* (2006.01)
*H04R 25/00* (2006.01)

(52) U.S. Cl. ..... 381/74; 381/315; 381/328; 381/151

(58) Field of Classification Search ..... 381/74, 381/151, 384, 312, 315, 328, 77, 79, 85, 381/123–124, 105

See application file for complete search history.

(56) References Cited

U.S. PATENT DOCUMENTS

| | | | | |
|---|---|---|---|---|
| 5,144,678 | A | 9/1992 | Lenz | |
| 6,236,732 | B1 | 5/2001 | Griffith | |
| 6,560,468 | B1 * | 5/2003 | Boesen | 455/569.1 |
| 7,206,429 | B1 * | 4/2007 | Vossler | 381/381 |
| 2001/0046304 | A1 * | 11/2001 | Rast | 381/74 |
| 2002/0003889 | A1 | 1/2002 | Fischer | |
| 2003/0012389 | A1 | 1/2003 | Brice et al. | |

FOREIGN PATENT DOCUMENTS

| | | | |
|---|---|---|---|
| EP | 1109382 | A2 | 6/2001 |
| JP | 64001400 | A | 1/1989 |
| JP | 04140916 | A | 5/1992 |
| JP | 05062290 | | 3/1993 |
| JP | 08195997 | | 7/1996 |
| JP | 10294996 | A | 11/1998 |

(Continued)

OTHER PUBLICATIONS

Peter Nonhoff-Arps, Sven Hansen, "Plattenmeister", C'T 2002 Heft 26, pp. 132-141, available with product No. M8737LL/A (see also http://www.apple.com/ipod/).

(Continued)

*Primary Examiner* — Vivian Chin
*Assistant Examiner* — George Monikang

(57) ABSTRACT

In a personal audio system (100), a remote controller (120) has a touch-sensitive area (122) and is worn in or by a human ear. A temporal pattern in the area (122), which is being touched, is detected and used for remotely controlling a device (110) for personal audio by means of a control signal (130). This prevents the hassle involved in finding, manipulating and operating a conventional remote control that is typically dangling somewhere along a wire.

27 Claims, 3 Drawing Sheets

FOREIGN PATENT DOCUMENTS

| | | | |
|---|---|---|---|
| JP | 11220788 | A | 10/1999 |
| KR | 1019990053268 | Q | 6/2001 |
| WO | WO0102949 | A | 1/2001 |

OTHER PUBLICATIONS

Jun Rekimoto, "PreSense: Interaction Techniques for Finger Sensing Input Devices", UIST '03 Vancouver, BC 2003 ACM 1-58113-636-6, vol. 5, issue 2, Letters Chi.

Ken Hinckley, "Toward More Sensitive Mobile Phones", Microsoft Research, Letter Chi, vol. 3, Issue 2.

Paul H. Dietz, "Real-Time Audio Buffering for Telephone Applications", UIST '01 Orlando FL, ACM 2001, 1-58113-438, vol. 3, issue 2, Letter Chi, pp. 193-1194, Nov. 14, 2001.

Ken Hinckley, "Sensing Techniques for Mobile Interaction", Microsoft Research, UIST '00, San Diego,CA, ACM 1-58113-212-3, CHI Letters, vol. 2, issue 2, pp. 91-100.

Ken Hinckley, "Touch-Sensing Input Devise", Microsoft Research, ACM 1999 0-201-1, Chi Letters, '99, pp. 223-230.

* cited by examiner

PERSONAL AUDIO SYSTEM WITH EARPIECE REMOTE CONTROLLER

The invention relates to a personal audio system comprising a remotely controllable device and a controller for remotely controlling the device by sending a control signal to the device.

The invention also relates to a controller for remotely controlling a personal audio device.

The invention also relates to a personal audio device, which is remotely controllable by a controller.

A personal audio system as described in the opening paragraph is known from the now ubiquitous mobile audio devices like MP3 players and mobile phones. One particular example of such a system is the iPod MP3 player from Apple as reviewed in c't 2002 Heft 26, pages 132-141, "Plattenmeister" by Peter Nonhoff-Arps, Sven Hansen, and available with product no. M8737LL/A (see also http://www.apple.com/ipod/).

This and similar products typically comprise a set of two earpieces also known as ear buds that can be inserted into the ears of the user. These products typically also include a remote controller for controlling one or more functions of the device. A plug connects both the remote controller and the earpieces with the device, by plugging it into a socket of the device. The remote controller is usually included in the wire somewhere between the earpieces and the plug.

As a result, the remote control has no fixed position but is dangling about as part of the wire. Hence, when the user wants to use the remote control for e.g. lowering volume, muting, or skipping an audio track or station, the user first needs to look for the remote controller. Subsequently, the user needs to get hold of the controller. This needs to be done in such a way that the controller has the right orientation for operating it. Finally, after being confident about the orientation of the controller, the user may try to find and operate the tiny button to activate the desired function.

This requires considerable time and attention from the user, which may lead to dangerous situations when the user takes part in traffic.

It is an object of the present invention to provide a personal audio system as described in the opening paragraph that does not suffer from the above-mentioned drawbacks.

This object is realized in that the controller has an outer surface with a touch-sensitive area, the controller being arranged to be substantially worn in or by a human ear, the controller being further arranged to detect the touch-sensitive area being touched, and to send the control signal in response to detecting the touch-sensitive area being touched.

The remote controller thus gets a fixed position with respect to the user in or by the human ear. It is easy to find one's ear. This prevents looking for the remote controller. In addition, the user is not tempted to look at the remote controller, because there is nothing relevant to be seen for controlling the device. To avoid having to find tiny buttons, merely touching the remote controller somewhere on its touch-sensitive area operates said remote controller, which detects being touched and subsequently sends the control signal to the device. Also the problem of finding the proper orientation of the remote controller is solved by wearing the remote controller in or by the ear, because its orientation becomes fixed with respect to the user.

Advantageously, the controller is arranged to fit substantially in a human ear concha, such that the area is accessible for touching when the controller is fitted substantially in the concha. This fits in with a particularly comfortable and popular shape for the earpieces or ear buds. The shape consists of a thick disc containing a transducer and a protruding part from which a wire extends. When being worn, the protruding part of the earpiece offers a surface area that is easily accessible for touching.

Advantageously, the controller is arranged to detect a temporal pattern in the touch-sensitive area being touched, and to send the control signal in response to detecting the temporal pattern. In general, the device offers a plurality of functions and capabilities. Rather than having more buttons on the remote control that may be hard to distinguish, the single touch-sensitive area is used for controlling the plurality of functions. The temporal pattern is a particularly appropriate user interface, because it is easy to create temporal patterns in touching the area rhythmically and because the temporal patterns can constitute a natural and consistent interface. An example is a single short tap for pause/play, double short tap for next track, triple short tap for next artist/album and a long tap for adjusting the volume.

Advantageously, the outer surface has a further touch-sensitive area, such that the further touch-sensitive area is touched substantially by the ear when the controller is substantially worn in or by a human ear, the controller being arranged to send the control signal only if the further touch-sensitive area is touched. This will prevent the accidental remote control of the device when the remote controller is not worm, thus preventing unwanted activation of the device and unnecessary battery exhaustion.

Advantageously, the controller is arranged to send a further control signal to the device if the further touch-sensitive area is touched. This makes it, for example, possible for the device to pause playing music as soon as the earpiece is taken out and to resume playing music upon re-insertion.

In an embodiment of the personal audio system according to the invention, the system comprises a second controller for remotely controlling the device by sending a further control signal to the device, the second controller having an outer surface with a further touch-sensitive area, the second controller being arranged to be substantially worn in or by a human ear, and the second controller being further arranged to detect a further temporal pattern in the further touch-sensitive area being touched, and to send the further control signal in response to detecting the further temporal pattern. A second controller fits in with the natural symmetry of the human head. It also considerably enhances the user interface for controlling the device. For example, the symmetry can be exploited in such a way that a long tap at the left remote controller decreases the volume, but a long tap at the right controller increases the volume.

The above object and features of the present invention will be more apparent from the following description of the preferred embodiments with reference to the drawings wherein.

Throughout the figures, identical reference numerals indicate similar or corresponding features. Some of the features indicated in the drawings may be implemented in software, and as such represent software entities, such as software modules or objects.

Figure 1:
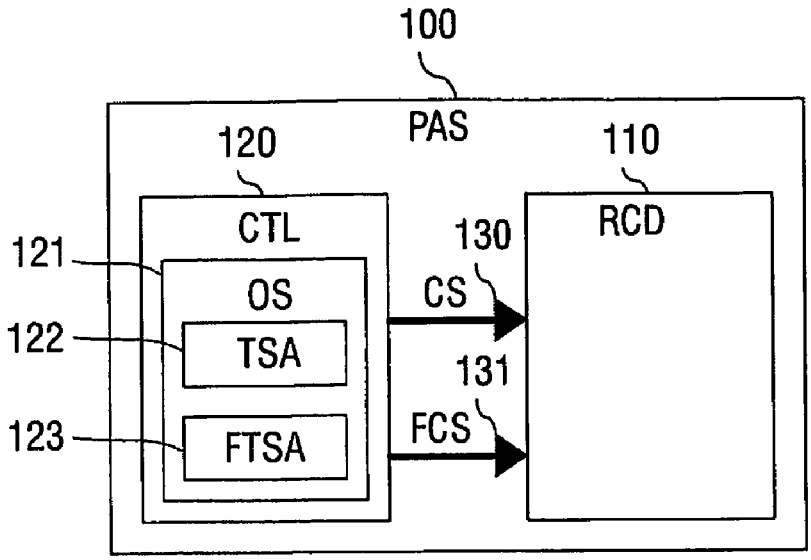
FIG. 1 is a block diagram of an embodiment of a system 100 according to the invention.

FIG. 1 is a block diagram of an embodiment of a personal audio system 100 according to the invention. The personal audio system 100 comprises a remotely controllable device 110 and a controller 120 that remotely controls the device 110 by sending a signal 130 to the device 110.

The remotely controllable device 110 may be, for example, a device for the reproduction of audio from storage media like tape, disc, memory, CD, DVD, etc. It may also reproduce audio from signals like radio signals or packet streams broadcast via media like the air, wireless LAN, Internet, etc. The audio source may be portable as the device 110, but the audio may also originate from a home audio set. The device 110 may also be a communication or messaging device like a mobile phone or a personal digital assistant. The device 110 has several functions or capabilities that alter, for example, the reproduction process, like a function to start playing the next track of a playlist, or jump to the next channel or station, or change a volume level, or change the reproduction speed, or start or stop a communication session, etc.

The controller 120 is used for commanding the device 110 to perform one or more of its functions or capabilities. The basic assumption is that the device 110 is remote or tucked away in a pocket or clamped to a belt or clothing, such that operating it becomes relatively hard. The controller 120 makes it possible to operate the device 110. The controller 120 is generally wired to the device 110 by means of a wire 140 (see FIG. 2) and a plug (not shown) that fits into a socket (not shown) of the device 110.

Figure 2:
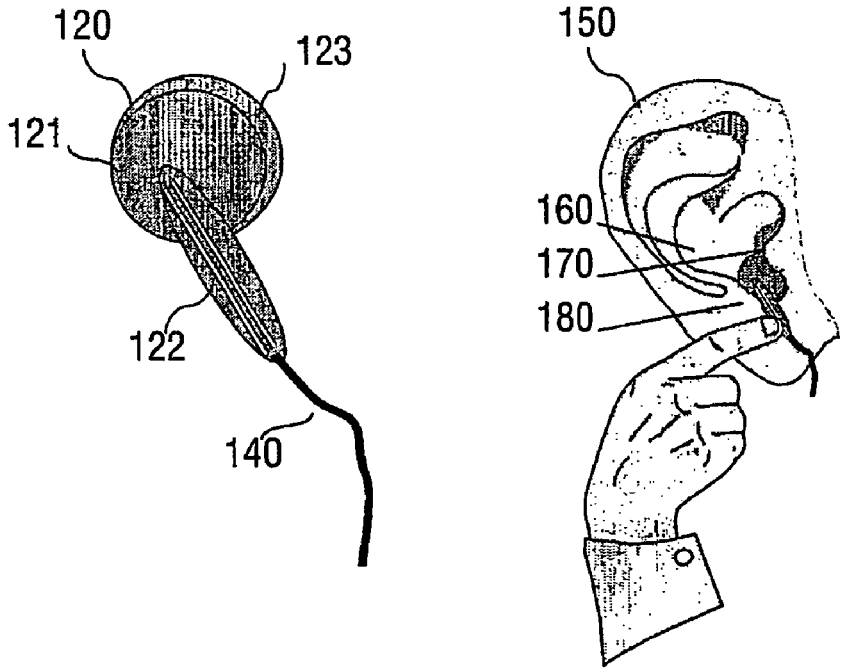
FIG. 2 shows an example of an embodiment of the remote controller 120 according to the invention.

The remote controller 120 has an outer surface 121, see also FIG. 2. The outer surface 121 is just the physical outer side of the controller 120. A part of this outer surface 121 is sensitive to being touched and is referred to as the touch-sensitive area 122. Optionally, the controller 120 comprises a second area that is sensitive to being touched, referred to as the further touch-sensitive area 123. The touch-sensitive area 122 can be realized in many ways, including a sensor for changes in capacity or induced voltages or currents, a grid of conducting parts between which changes in resistance are measured and detected, or an ordinary pressure sensor, button or temperature sensor. Another possibility is to measure and detect changes in either a passive or an active electromagnetic field. With the passive variant, the controller 120 relies on, for example, nearby power lines to generate measurable fields when being touched. With the active variant, the controller 120 generates an electromagnetic field of its own.

Figure 5:
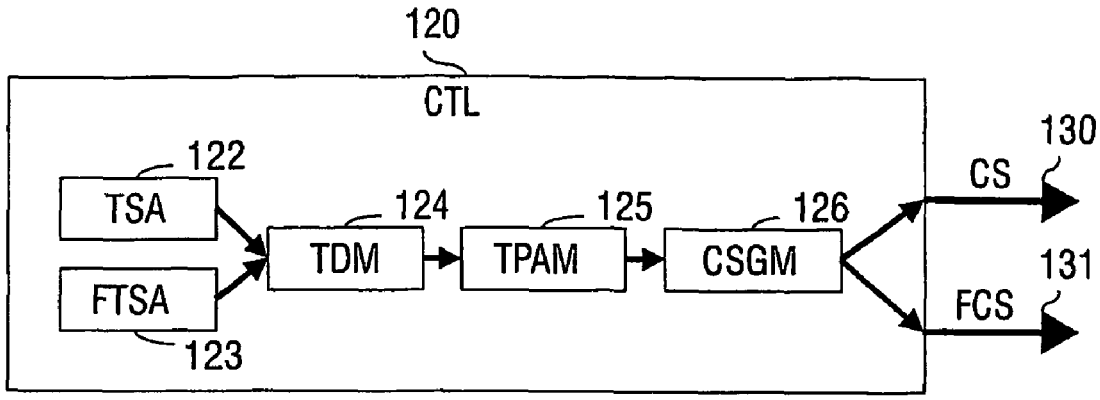
FIG. 5 is a block diagram of an embodiment of the remote controller 120 according to the invention.
Figure 6:
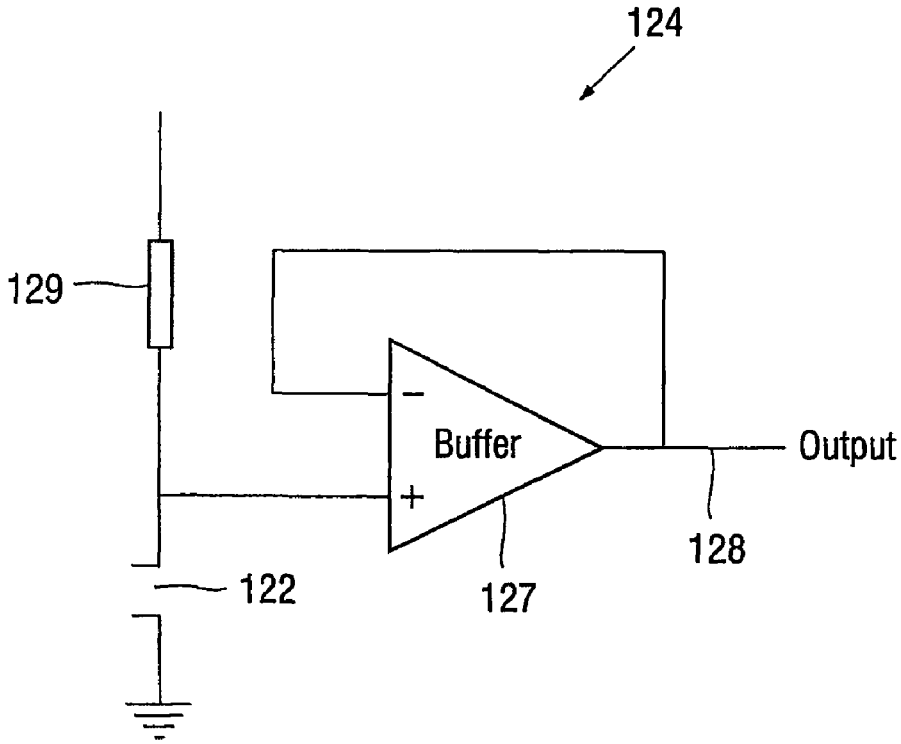
FIG. 6 shows an example of a touch detection circuit 124 of an embodiment of the remote controller according to the invention.

FIG. 5 is a block diagram of an embodiment of the remote controller 120 according to the invention. The touch-sensitive area 122 and the further touch-sensitive area 123 are coupled to touch-detecting means 124. The touch-detecting means 124 measures the internal resistance of a part of the human body that touches the touch-sensitive area 122. FIG. 6 shows an example of a circuit for the touch-detecting means 124. The internal resistance is determined with a voltage divider composed of the touch-sensitive area 122 and a resistor 129. Without touching, the output voltage of the divider will be the supply voltage, but with touching, the output voltage will decrease. Touching can thus be detected. The output voltage of the voltage divider 129, 122 is input for a buffer 127 that provides a copy of the voltage at its output 128.

The output of the touch-detecting means 124 can be coupled to the input of temporal pattern analysis means 125. The temporal pattern analysis means 125 may comprise an A/D-converter (not shown) for converting the analog output signal of the touch-detecting means 124 into a digital representation of the output signal. The output signal of the temporal pattern analysis means 125 that represent detected temporal patterns may be coupled to control signal generating means 126, for generating and transmitting the control signal 130 and the further control signal 131.

The control signal 130 sent by the controller 120 to the device 110 can take several forms. One example is that the control signal 130 is an electric DC current that runs upon closing a circuit between a pair of conductors in the wire 140. Also several resistance levels between two pins (not shown) of the plug (not shown) may represent several control signals. Another example is an electric AC current or voltage with a particular frequency or frequencies. These frequencies may advantageously be above the frequencies perceived by a human ear, so as to be multiplexed on the same wire 140 that carries audio frequencies. Yet another example is a digital electric signal. Wire 140 may carry the control signal 130, but other media like air or fiber could also carry it, especially in the case of an electromagnetic signal.

According to the invention, the remote controller 120 is suited to be worn in or by a human ear. The remote controller 120 may have various shapes and forms to meet this requirement. It could fit almost entirely in the auditory canal, much like a miniature hearing aid device, but it could also have the shape of a more conventional hearing aid device worn behind the ear cup, or a headset with a band over the head or in the neck, or the shape of a neck strap for carrying the device 110.

FIG. 2 shows an example of an embodiment of the remote controller according to the invention. A particularly comfortable and popular shape of the remote controller 120 consists of a thick disc containing a transducer and a protruding part from which a wire 140 extends. The disc fits in a concha 160 of a human ear 150 and is kept there by friction. The disc may in addition be kept there by the presence of a tragus 170 and an antitragus 180, being two cartilaginous edges of the conchal bowl 160 of the human ear 150. When being worn, the protruding part of the remote controller 120 offers a surface area 122 that is easily accessible for touching.

Figure 3:
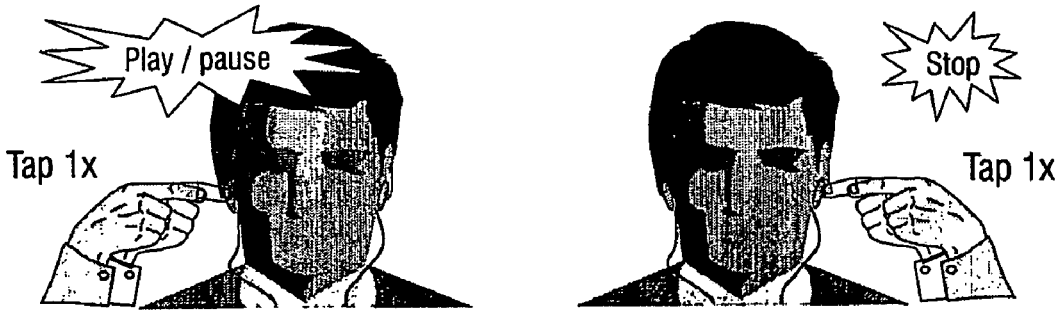
FIG. 3 shows an example of the functionality offered by an embodiment of the system 100 according to the invention.
Figure 4:
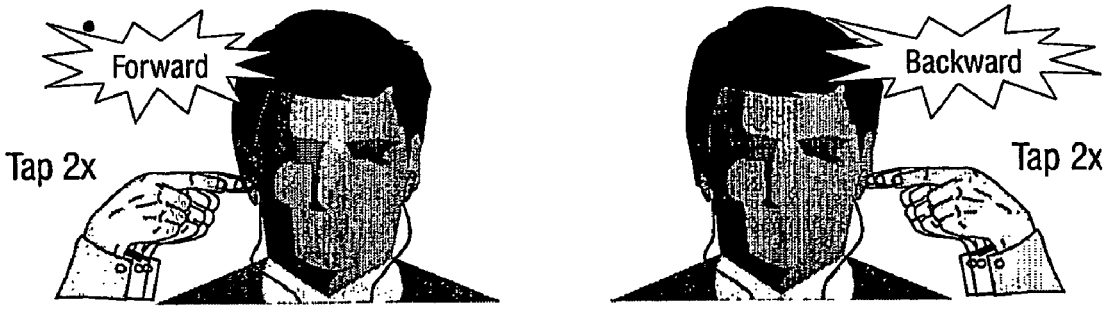
FIG. 4 shows another example of the functionality offered by an embodiment of the system 100 according to the invention.

FIG. 3 shows an example of the functionality offered by an embodiment of the system according to the invention. FIG. 4 shows another example of the functionality offered by an embodiment of the system according to the invention. The functionality of detecting temporal patterns offers a user interface that is convenient, logical and consistent.

A basic temporal pattern that can be detected is a short tap, which consists of the touch-sensitive area 122 being initially untouched and subsequently being touched for a short while, and subsequently being untouched again. The short while typically lasts between 40 and 300 milliseconds. Another basic temporal pattern is the long tap, which typically lasts between 400 milliseconds to several seconds. Yet another basic temporal pattern is a repeated long or short tap or another sequence of long and short taps. All of these temporal patterns may each be mapped to functions or capabilities of the device 110.

The detection of the temporal pattern is preferably insensitive to deviations of the duration of the tap and to the criteria for determining being touched, like measured quantity levels and hysteresis. The detection of the temporal pattern may adapt itself to the history of detected patterns.

One particular mapping may be, for example, that, in response to detecting a touch and hold, the device 110 gradually adapts a volume level as long as the area 122 is being touched. The direction of adaptation (increasing or decreasing the volume level) can be reversed with every touch and hold, or with a short tap in between.

The system 100 may comprise two controllers 120, one for each ear of the user. The temporal patterns detected by the system 100 may depend on the aggregate of each of the four areas of the controllers 120 being touched, such that, for example, more exotic functions require substantially simultaneous tapping on both controllers 120.

To provide a consistent user interface with a system 100 with two controllers 120, the system may have a function to swap the temporal patterns between the controllers 120 if the left and the right controller are inserted into the right and the left ear, respectively. This function effectively swaps the remotely controlled functionality between the controllers 120. Assuming that the user always first inserts either controller 120 into, for example, the left ear, the function may be triggered by determining the controller 120 that is inserted first.

To further enhance the user interface, the device 110 may provide immediate acoustic feedback in response to being touched. One example of such feedback is providing an audible hum or beep when the area 122 is detected as being touched. Another example is that the audio feedback represents the activated function of the device 110, for example, by varying volume, pitch, rhythm or melody or combinations thereof of the audio feedback. Yet another example of feedback is the use of a recorded or synthesized human voice informing the user about the activated function of the device 110 or about the capabilities of the device 110 and how to remotely control them.

The controller 120 may favorably be backward compatible with devices according to the prior art, such that the controller 120 according to the invention can be plugged in and used with conventional devices. Similarly, the device 110 may be backward compatible with controllers according to the prior art, such that the device 110 according to the invention can still (partially) be remotely controlled from conventional controllers.

In the above description, both the sensing functionality and the detecting functionality of being touched have been implemented at the remote controller 120. Another possibility, however, is to allocate only the sensing part (this is the measurement of a quantity) at the controller 120, while allocating the detecting part, in particular the temporal pattern analysis means 125, at the device 110. This may offer advantages like reducing the complexity of the remote controller 120, while the device 110 may already have the means to perform the detection, especially when it is done partially or as a whole in software.

The number of wires between the remote controller 120 and the device 110 can be reduced by applying a phantom power supply providing power to, for example, the touch-detecting means 124 in the remote controller 120.

The functionality of the remote control may be extended in several ways.

In a first way, the touch-sensitive area is used to detect a tempo of being tapped. The tempo detected may be used to adjust a rhythm of a sound, e.g. as transferred by the personal audio system. The tempo detected may also be used to find or select matching content, for example, a song with a tempo that resembles the tempo detected. The tempo detected may also be used to adapt the speed of playback of the current music to the tempo detected. The tempo detected may also be used to enter metadata that pertains to the currently played music, by tapping along in the same tempo. An advantage is that tempo information may be entered in a natural way, without being dependent on menu navigation on a player that is relatively hard to operate. Another advantage is that no complex algorithms are required for obtaining meaningful and accurate tempo information, because relatively simple time averaging logic suffices.

In a second way, the touch-sensitive area is used for detecting a pressure with which the area is touched. When a person presses harder on the touch-sensitive area of the remote control, more skin contacts the area. This increases a conductivity and lowers the measured skin resistance. By means of a precise measurement it is possible to sense these differences in pressure. The pressure may for example be used for a more sophisticated volume and cueing control. An example is changing a setting with a speed that is proportional with the pressure.

In a third way, the touch-sensitive area is used for picking up a gesture made on the area with e.g. a stylus or a finger. The remote control may be extended for this purpose with means for detecting a gesture, e.g. a laser beetle, a small camera, an IR movement sensor, or a cross-capacitance sensor. The system may be arranged to detect a gesture being made on the area. The gesture detected may be used for controlling a setting of the system. Examples of a setting are a selection of a next or a previous track, a volume, a position of a stereo image, e.g. a panning position, a balance position. The gesture detected may also be used for controlling a mouse pointer, navigating a menu, entering a tapping pattern, scrolling content on display. The gesture detected may be a character, like a letter from an alphabet. The character detected may be used for jumping in a list to an entry with a first letter corresponding to the character detected. The list may contain items like contacts, artists, song titles, etc. The gesture detected may be a user defined gesture for activating a user defined function. The gesture detected may be used for user identification by matching with initials or an autograph. The gesture may extend into two dimensions, e.g. a planar gesture, or it may extend into three dimensions.

In a fourth way, the system may be arranged to operate in a plurality of modes, and to switch between the modes. A function that depends on the mode may be invoked in response to an input on the remote control. Each mode may e.g. correspond to an application of the system. The system may switch to another application in response to a command of the user, for example given via the touch-sensitive area Touching the left earpiece, for example, may cause a move through a circular list of applications, and an application may be activated by touching the right earpiece. Also multiple applications may be active simultaneously, in which case a special command may be used to switch between applications, e.g., hold one earpiece while tapping on the other. Of course, other combinations may be used for this. Another way of switching between applications may not be initiated by the user, but by the system, e.g., on an incoming phone call or some other event. As soon as the incoming phone call is detected, the ring tone may be sounded, potentially mixed with the active sound source e.g. MP3 playback. While the incoming phone call is communicated to the user, the controls are mapped to the phone application rather than the audio playback application. In the phone application, touching the right earpiece could be mapped on answering the call and the left earpiece could be mapped to hanging up. As the user picks up the call, the playback of the music may be paused.

The personal audio system may include means for rendering video e.g. a audio/video set, or means for playing a game, e.g. a gaming device, or means for communication, e.g. a messaging device or telephone.

It is noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. Use of the indefinite article "a" or "an" preceding an element or step does not exclude the presence of a plurality of such elements or steps. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A personal audio system comprising:

a remotely controllable device, a first controller for remotely controlling the device by sending a first control signal to the device, a second controller for remotely controlling the device by sending a second control signal to the device, wherein:

each of the first controller and the second controller includes an outer surface with a touch-sensitive area, and is configured to:

be substantially worn in or by a human ear, detect a touching of the touch-sensitive area, and send the corresponding control signal to control one or more functions of the personal audio system based on the touching;

at least one of the one or more functions being controlled by the first controller differs from one or more functions being controlled by the second controller; and wherein the outer surface of at least one of the controllers includes a second touch-sensitive area, such that the second touch-sensitive area is touched substantially by the ear when the controller is substantially worn in or by a human ear, the controller being arranged to send the corresponding control signal only if the second touch-sensitive area is touched.

2. The system of claim 1, wherein each controller is arranged to fit substantially in a human ear concha, such that the touch-sensitive area is accessible for touching when the controller is fitted substantially in the concha.

3. The system of claim 1, wherein at least one of the controllers is arranged to detect a predefined temporal pattern in the touching of the touch-sensitive area, and to send the corresponding control signal in response to detecting the temporal pattern.

4. The system of claim 1, wherein the outer surface of at least one controller includes a third touch-sensitive area, and is arranged to send a second control signal to the device if the second touch-sensitive area is touched.

5. The system of claim 1, including a touch-detecting device that measures internal resistance of a part of the human body that touches the second touch-sensitive area.

6. The system of claim 1, wherein including a touch-detecting device that includes a disc that includes a transducer and a protruding part having a touch-sensitive area, wherein the disc fits in a concha of an ear.

7. The system of claim 1, wherein the touch-sensitive area of at least one of the controllers detects an amount of pressure with which the touch-sensitive area is touched.

8. The system of claim 1, wherein the second touch-sensitive area is positioned between the tragus and anti-tragus of the ear during use.

9. A method for remote control of a personal audio device, the method comprising:

wearing a pair of controllers substantially in or by a pair of human ears;

detecting a touching of a touch-sensitive area of each of the controllers; and sending a control signal to the device in response to detecting the touching of each touch-sensitive area to control one or more functions of the personal audio system;

wherein at least one of the one or more functions being controlled by a first controller of the pair of controllers differs from one or more functions being controlled by a second controller of the pair of controllers; and the outer surface of at least one of the controllers includes a second touch-sensitive area, such that the second touch-sensitive area is touched substantially by the ear when the controller is substantially worn in or by a human ear, and the sending of the control signal occurs only if the second touch-sensitive area is touched.

10. A pair of earbuds coupled to a corresponding pair of channels of an audio device, each earbud comprising: a transducer that is configured to provide sound from the corresponding channel of the audio device, and a sensor that is configured to detect a touch of the earbud, and to provide an indication of the touch to the audio device, to facilitate control of the audio device based on the indications from the pair of earbuds; wherein at least one function being controlled by the indication of the touch from a first earbud of the pair of earbuds differs from each function being controlled by the indication of touch from a second earbud of the pair of earbuds, and the outer surface of at least one of the controllers includes a second touch sensitive area, such that the second touch-sensitive area is touched substantially by the ear when the controller is substantially worn in or by a human ear, the controller being arranged to send the corresponding control signal only if the second touch-sensitive area is touched.

11. The pair of earbuds of claim 10, wherein the at least one earbud is configured to provide the indication of the touch only if the other sensor detects the earbud being placed in the ear.

12. The pair of earbuds of claim 10, wherein the at least one earbud is configured to provide an other indication to the audio device if the other sensor detects the earbud being placed in the ear.

13. A device comprising:

a source of audio content material, an audio amplifier that is configured to provide a pair of audio output signals to a corresponding pair of earbuds, and a control element that is configured to receive indications of touchings of each earbud of the pair of earbuds, and to control the device based on these indications;

wherein at least one function being controlled by the indications of touchings from a first earbud of the pair of earbuds differs from each function being controlled by the indications of touchings from a second earbud of the pair of earbuds, and the outer surface of at least one of the ear buds includes a second touch-sensitive area, such that the second touch-sensitive area is touched substantially by the ear when the ear bud is substantially worn in or by a human ear, the control element being configured to control the device only if the second touch-sensitive area is touched.

14. The device of claim 13, wherein the pair of earbuds includes a first earbud and a second earbud, and the control element is configured to distinguish the indications of the touching of each earbud, and to control the device differently based on whether the first earbud or second earbud provides the indication of the touching.

15. The device of claim 14, wherein the indication of touching of the first earbud causes a volume of the output signals to increase, and the indication of touching of the second earbud causes the volume to decrease.

16. The device of claim 14, wherein the audio content is arranged for rendering in a sequence of audio segments, and the indication of touching of the first earbud causes a selection of a prior audio segment in the sequence for rendering, and the indication of touching of the second earbud causes a selection of a subsequent audio segment.

17. A personal audio system comprising: a remotely controllable device, a controller for remotely controlling the device by sending a control signal to the device, wherein the controller includes an outer surface with a first touch-sensitive area, and is configured to: be substantially worn in or by a human ear, detect a touching of the touch-sensitive area when the controller is substantially worn in and by the human ear, and send the control signal to control one or more functions of the personal audio system based on the touching and the outer surface of at least one of the controllers includes a second touch sensitive area, such that the second touch-sensitive area is touched substantially by the ear when the controller is substantially worn in or by a human ear, the controller being arranged to send the corresponding control signal only if the second touch-sensitive area is touched.

18. The personal audio system of claim 17, wherein the control signal causes the device to pause when the controller is removed from the ear, and to resume upon the touching of the touch-sensitive area when the controller is substantially worn in and by the human ear.

19. The system of claim 17, including a second touch-sensitive area, wherein the controller is arranged to detect a predefined temporal pattern in the touching of the second touch-sensitive area, and to send an other control signal in response to detecting the temporal pattern.

20. The system of claim 19, wherein the controller is configured to send the other control signal only when the controller is substantially worn in and by the human ear.

21. The system of claim 19, wherein the second touch-sensitive area detects an amount of pressure with which the touch-sensitive area is touched.

22. The system of claim 19, wherein the controller is arranged to fit substantially in a human ear concha, such that the first touch-sensitive area detects that the controller is fitted substantially in the concha, and the second touch-sensitive area is accessible for touching by a finger when the controller is fitted substantially in the concha.

23. The system of claim 17, wherein the controller is configured to operate in a plurality of modes, each mode corresponding to a different audio application.

24. The system of claim 23, wherein a first audio application includes a playback mode, and a second audio application includes a phone mode, and the controller is configured to pause the playback mode when the phone mode is entered, and to resume the playback mode when the phone mode is exited.

25. The system of claim 24, wherein the controller controls when the phone mode is entered and exited.

26. The system of claim 24, wherein the controller controls entering and exiting the phone mode based on a touching of the first touch-sensitive area.

27. The system of claim 24, wherein the controller includes a second touch-sensitive area and controls entering and exiting the phone mode based on a touching of the second touch-sensitive area.

* * * * *